United States Patent [19]

Mowbray

[11] 4,242,059

[45] Dec. 30, 1980

[54] FUEL PUMPING APPARATUS

[75] Inventor: Dorian F. Mowbray, Burnham, England

[73] Assignee: Lucas Industries Limited, Birmingham, England

[21] Appl. No.: 6,168

[22] Filed: Jan. 24, 1979

Related U.S. Application Data

[63] Continuation of Ser. No. 787,352, Apr. 14, 1977, abandoned.

[30] Foreign Application Priority Data

Apr. 20, 1976 [GB] United Kingdom ..... 15898/76

[51] Int. Cl.[3] ..... F04B 19/22; F09B 29/00

[52] U.S. Cl. ..... 417/462

[58] Field of Search ..... 417/462, 218

[56] References Cited

U.S. PATENT DOCUMENTS

| | | | |
|---|---|---|---|
| 2,901,974 | 9/1959 | Evans | 417/462 |
| 3,439,359 | 4/1969 | Thoma | 123/32 G |
| 3,771,506 | 11/1973 | Davis | 417/218 |
| 3,861,835 | 1/1975 | Bakti | 417/462 |
| 3,883,270 | 5/1975 | Baxter | 417/462 |
| 4,033,301 | 7/1977 | Walton | 123/32 G |
| 4,050,437 | 9/1977 | Hollett | 417/462 |

FOREIGN PATENT DOCUMENTS

| | | | |
|---|---|---|---|
| 2333962 | 1/1975 | Fed. Rep. of Germany | 123/32 G |
| 237487 | 7/1969 | U.S.S.R. | 417/462 |
| 266468 | 8/1970 | U.S.S.R. | 417/462 |

*Primary Examiner*—William L. Freeh

[57] ABSTRACT

A liquid fuel pumping apparatus for supplying fuel to a compression ignition engine comprises a rotary distributor member which contains a transverse bore housing a pair of main pumping plungers. The main plungers are moved inwardly by cam lobes formed on the internal peripheral surface of the cam ring, there being a plurality of pairs of such cam lobes. Also provided is a further pair of pumping plungers of smaller diameter and these are actuated by another of the pair of cam lobes slightly in advance of the actuation of the main pumping plunger. Pilot injection is provided by the smaller pair of plungers.

1 Claim, 3 Drawing Figures

FIG. 1.
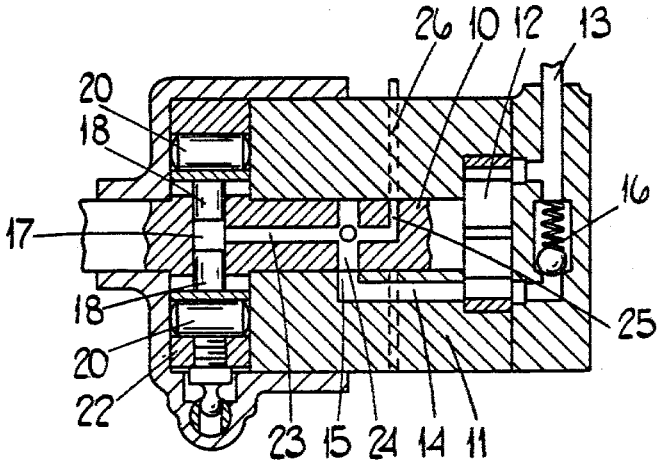
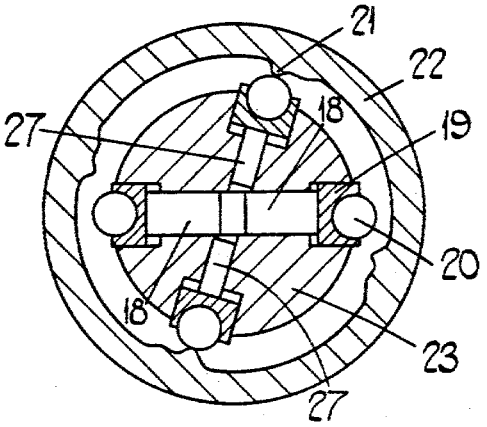
FIG. 2.
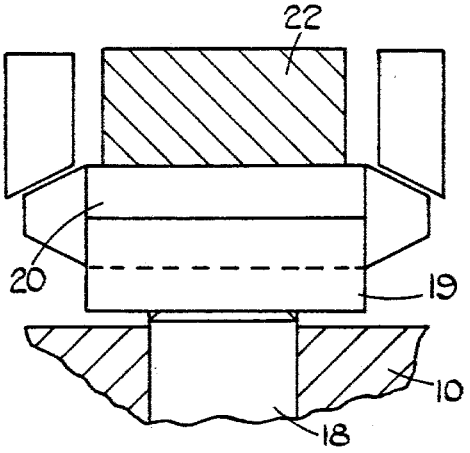
FIG. 3.

FUEL PUMPING APPARATUS

This is a continuation, of application Ser. No. 787,352, filed Apr. 14, 1977 now abandoned.

This invention relates to fuel pumping apparatus for supplying fuel to a compression ignition engine and of the kind comprising a rotary distributor member located within a housing, a transverse bore formed in the distributor member, a pair of plungers in the bore, a cam ring surrounding the distributor member, a plurality of pairs of diametrically disposed cam lobes formed on the internal periphery of the cam ring for imparting inward movement to the plungers as the distributor member rotates, inlet port means in the distributor member and housing and through which fuel can be supplied to the pump chamber defined by the plungers and the bore, stop means to limit the outward movement of the plungers as fuel is supplied to the pump chamber and outlet port means in the distributor member and housing and through which fuel displaced from the pump chamber flows during inward movement of the plungers, said outlet port means including an outlet which in use is connected to a fuel injection nozzle of the associated engine.

It is known that the operation of a compression ignition engine can be improved by supplying a small quantity of the total fuel charge to the engine slightly earlier than the main quantity of fuel. The technique is known as pilot injection and the object of the present invention is to provide an apparatus of the kind specified in a form in which pilot injection can be achieved.

According to the invention an apparatus of the kind specified comprises a further pair of diametrically opposed plungers housed in respective bores communicating at their inner ends with said pump chamber, said further pair of plungers being of smaller diameter than the first mentioned pair of plungers, said further pair of plungers being positioned so that during rotation of the distributor member they will be moved inwardly slightly before the first mentioned pair of plungers and during the time when fuel can flow through said outlet port means.

According to a further feature of the invention said further pair of plungers are actuated by another of the pairs of diametrically opposed cam lobes.

According to a further feature of the invention said further pair of plungers are actuated by cam lobes formed on the internal periphery of a further cam ring.

One example of a fuel pumping apparatus in accordance with the invention will now be described with reference to the accompanying drawings, in which:

FIG. 1 is a sectional side elevation of one example of a fuel pumping apparatus to which the invention may be applied, FIG. 2 shows in cross-section the modification necessary to FIG. 1, and FIG. 3 is a sectional view of the fuel pumping apparatus illustrating stops for limiting the outward movement of the plungers.

Referring to FIG. 1 of the drawings there is provided a rotary distributor member 10 which is mounted in a housing 11. The distributor member 10 is adapted to be driven in timed relationship with the associated engine and at one end is coupled to the rotary part of a feed pump 12 which has an inlet 13 for connection to a source of fuel. The feed pump has an outlet 14 communicating with an inlet port 15 opening on the periphery of the distributor member. Moreover, the inlet and the outlet of the pump are interconnected by means of a relief valve 16 the action of which is to control the output pressure of the feed pump conveniently so that it varies in accordance with the speed at which the apparatus is driven.

Formed within the distributor member is a transversely extending bore 17 which accommodates a pair of plungers 18. The plungers at their outer ends bear against shoes 19 (FIG. 2) which carry rollers 20. The rollers engage during rotation of the distributor member with cam lobes 21 formed on the internal periphery of an annular cam ring 22 located within the housing.

The portion of the bore 17 defined between the plungers 18 communicates with a passage 23 extending within the distributor member and communicating at one point with a plurality of radially disposed inlet passages 24 positioned to register in turn and as the distributor member rotates, with the aforesaid inlet port 15. The passage 23 is also in communication with a delivery passage 25 which can register in turn and as the distributor member rotates, with a plurality of outlet passages 26 formed in the housing and communicating in use, with respective injection nozzles of the associated engine.

As shown in FIG. 1, an inlet passage 24 is in register with the inlet port 15 and the fuel flows to the bore 17 to move the plungers outwardly their maximum extent. During continued rotation of the distributor member, the inlet passage is moved out of register with the inlet port and the delivery passage 25 moves into register with an outlet passage 26. When this communication is established, the plungers 18 are moved inwardly thereby displacing fuel from the bore 17 to the associated engine.

In order to control the volume of fuel delivered by the apparatus, adjustable stops may be provided to limit the outward movement of the plungers alternatively, stops may be provided to limit the outward movement of the plungers and the amount of fuel supplied by the apparatus to the engine controlled in some other manner for example by spilling fuel during the inward movement of the plungers.

In order to provide for pilot injection of fuel to the associated engine the apparatus shown in FIG. 1 is modified as seen in FIG. 2. In the modification additional plungers 27 are provided which are of smaller diameter than the plungers 18. The plungers 27 are located within respective bores which communicate with the bore 17. The plungers 27 are provided with shoes and rollers to effect inward movement thereof. The apparatus shown in FIG. 2 is for supplying fuel to a four cylinder engine and therefore two pairs of cam lobes 21 are provided these being disposed at 90° relative to each other. Since the pilot injection of fuel should take place in advance of the main injection, the bores which accommodate the plungers 27 are angularly displaced in the direction of rotation of the distributor member, relative to the bore 17. In this manner, the rollers associated with the plungers 27, will engage with a pair of cam lobes in advance of the engagement of the rollers associated with the plungers 18 engaging the cam lobes. Thus the plungers 27 will be driven inwardly thereby to displace a small quantity of fuel to the engine prior to the delivery of the main quantity of fuel by the plungers 18. It should be noted that the inward movement of the plungers 27 and 18 can only be allowed to take place whilst the delivery passage 25 is in communication with an outlet 26. If this condition is not met then there is a possibility that the apparatus would be damaged by the very high pressure of fuel which might be developed. It is to be noted also that the pilot plungers 27 once the associated rollers have ridden over the crests of the cam lobes, will be driven outwardly due to inward movement of the plungers 18. Thus at the end of the delivery of fuel the plungers 27 will have moved outwardly their maximum extent and the plungers 18 will be occupying their inner most positions. When fuel is supplied to the bore 17 the plungers 18 will also be moved outwardly their maximum extent.

Conveniently the adjustable stops which control the amount of fuel supplied by the apparatus also operate on the plungers 27 so that as the quantity of fuel supplied to the engine decreases the quantity of fuel supplied during the pilot injection period is also reduced.

In FIG. 3 there is shown stops for limiting the outward movement of the plungers 18. These stops comprise a pair of rings which co-operate to engage with the tapered end portions of the rollers 20.

I claim:

1. A fuel pumping apparatus for supplying fuel to a compression ignition engine and of the kind comprising a housing, a rotary distributor member located within the housing, a transverse bore formed in the distributor member, a pair of plungers in the bore, a cam ring surrounding the distributor member, a plurality of pairs of diametrically disposed cam lobes formed on the internal periphery of the cam ring for imparting inward movement to the plungers as the distributor member rotates, inlet port means in the distributor member and housing and through which fuel can be supplied to the pump chamber defined by the plungers and the bore, stop means to limit the outward movement of the plungers as fuel is supplied to the pump chamber, outlet port means in the distributor member and housing and through which fuel displaced from the pump chamber flows during inward movement of the plungers, said outlet port means including an outlet which in use, is connected to a fuel injection nozzle of the associated engine, and a further pair of diametrically opposed bores formed in the distributor member and communicating with said pumping chamber, said further bores and said bore being disposed in the same radial plane, a further pair of plungers housed in the further bores respectively, said further pair of plungers and said bores being of smaller diameter than the first mentioned pair of plungers and said bore, said further pair of plungers being positioned so that during rotation of the distributor member they will be moved inwardly by a pair of said cam lobes slightly before the first mentioned pair of plungers, the inward movement of the further pair of plungers and said first mentioned pair of plungers taking place during the time when fuel can flow through said outlet port means.

* * * * *